US007749059B2

(12) United States Patent
Tarantino

(10) Patent No.: US 7,749,059 B2
(45) Date of Patent: Jul. 6, 2010

(54) POKER GAME WITH SEQUENTIAL HAND OPPORTUNITY

(75) Inventor: Elia Rocco Tarantino, Las Vegas, NV (US)

(73) Assignee: IGT, Reno, NV (US)

( * ) Notice: Subject to any disclaimer, the term of this patent is extended or adjusted under 35 U.S.C. 154(b) by 1352 days.

(21) Appl. No.: 10/434,980

(22) Filed: May 8, 2003

(65) Prior Publication Data

US 2004/0224743 A1 Nov. 11, 2004

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/11; 273/274; 273/292; 463/13; 463/16; 463/30

(58) Field of Classification Search ..... 463/11, 463/13, 16, 292, 26; 273/274, 292
See application file for complete search history.

(56) References Cited

U.S. PATENT DOCUMENTS

| | | | | |
|---|---|---|---|---|
| 4,743,022 | A * | 5/1988 | Wood | 463/13 |
| 5,019,973 | A * | 5/1991 | Wilcox et al. | 463/13 |
| 5,437,451 | A | 8/1995 | Fulton | |
| 5,722,661 | A * | 3/1998 | Skratulia et al. | 273/292 |
| 5,868,618 | A * | 2/1999 | Netley et al. | 463/13 |
| 5,897,436 | A | 4/1999 | Singer et al. | |
| 5,947,821 | A * | 9/1999 | Stone | 463/13 |
| 6,065,753 | A | 5/2000 | Morosky | |
| 6,193,606 | B1 * | 2/2001 | Walker et al. | 463/20 |
| 6,270,405 | B1 * | 8/2001 | Ferguson | 463/13 |
| 6,371,484 | B1 | 4/2002 | Yuan | |
| 6,416,407 | B1 | 7/2002 | Carrico et al. | |
| 6,419,578 | B1 * | 7/2002 | Moody et al. | 463/13 |
| 6,471,587 | B1 * | 10/2002 | Wood et al. | 463/13 |
| 6,474,645 | B2 * | 11/2002 | Tarantino | 273/274 |
| 6,481,717 | B1 * | 11/2002 | Richardelle | 273/292 |
| 6,569,013 | B1 * | 5/2003 | Taylor | 463/13 |
| 6,575,467 | B1 * | 6/2003 | Kal | 273/292 |
| 6,585,588 | B2 * | 7/2003 | Hartl | 463/16 |
| 6,612,927 | B1 | 9/2003 | Slomiany et al. | |

(Continued)

OTHER PUBLICATIONS

John Scarne, "Scarne's Encyclopedia of Card Games", Copyright 1973, 1983 by John Scarne Games, Inc., 57 pages.

*Primary Examiner*—John M. Hotaling, II
*Assistant Examiner*—Paul A. D'Agostino
(74) *Attorney, Agent, or Firm*—K&L Gates LLP

(57) ABSTRACT

A poker game offers the possibility of sequential hand play and large payoffs. In one embodiment, a first set of cards is used to form a first poker hand. A draw feature may allow the player to discard cards and obtain replacement cards. If the first poker hand is a predetermined winning set of cards or has a first rank, then the outcome is a winning outcome. Otherwise, the game ends. If the first hand is a winning outcome, the player may be paid winnings or play a subsequent hand in which the player attempts to achieve a hand having a higher rank than the previous hand. If the second hand has a higher rank than the previous hand, the player may be paid winnings or continue playing. In one embodiment, payouts for particular ranks or hands increase as the game continues.

15 Claims, 4 Drawing Sheets

U.S. PATENT DOCUMENTS

| | | | | |
|---|---|---|---|---|
| 6,638,163 | B2 * | 10/2003 | Moody | 463/13 |
| 6,672,959 | B2 * | 1/2004 | Moody et al. | 463/13 |
| 6,729,621 | B2 * | 5/2004 | Moody | 273/292 |
| 6,729,961 | B1 * | 5/2004 | Millerschone | 463/30 |
| 6,802,773 | B2 * | 10/2004 | Moody | 463/13 |
| 6,802,774 | B1 * | 10/2004 | Carlson et al. | 463/16 |
| 6,913,531 | B1 * | 7/2005 | Yoseloff | 463/13 |
| 7,201,654 | B1 * | 4/2007 | Jarvis et al. | 463/13 |
| 2002/0198040 | A1 | 12/2002 | Moody | |
| 2003/0032469 | A1 * | 2/2003 | Moody et al. | 463/13 |
| 2003/0038425 | A1 * | 2/2003 | Tarantino | 273/274 |
| 2003/0100357 | A1 * | 5/2003 | Walker et al. | 463/16 |
| 2003/0107176 | A1 * | 6/2003 | Goldman et al. | 273/292 |
| 2003/0122305 | A1 * | 7/2003 | Malcolm | 273/292 |
| 2003/0130023 | A1 | 7/2003 | Angel | |
| 2005/0037839 | A1 * | 2/2005 | Yoseloff | 463/25 |
| 2005/0059462 | A1 | 3/2005 | Gerrard | |
| 2006/0258433 | A1 * | 11/2006 | Finocchio et al. | 463/16 |

* cited by examiner

POKER GAME WITH SEQUENTIAL HAND OPPORTUNITY

FIELD OF THE INVENTION

The present invention relates to card games and, more particularly, to poker-type card games.

BACKGROUND OF THE INVENTION

Poker is a popular card game which has many variations of play. As is known, the game of poker has been adapted for play on electronic gaming devices commonly referred to as "video poker machines." In the game of video poker, a player attempts to obtain a hand of cards which comprise one or more predetermined winning card combinations. For example, the winning card combinations may comprise a pair of Jacks or better. The player attempts to obtain a hand including cards of at least a pair of Jacks or better. If the player receives a winning hand, the player may be paid a payment. The game then ends.

In order to maintain the interest of players, a wide variety of game options have been presented. For example, in some games the amount which may be wagered varies. In other games, the hands which comprise predetermined winning hands vary.

One disadvantage to the game of video poker is that there is little opportunity for large payouts or jackpots. The largest payout is reserved for a Royal Flush. However, this card hand occurs infrequently. In most instances, if a player is a winner, he/she wins a small payout for a hand such as a Pair, Three of a Kind or the like.

It is desired to provide a poker game offering the player opportunities for higher stakes and winnings and which adds general excitement.

SUMMARY OF THE INVENTION

The present invention comprises a method of playing a game. In one embodiment, the game is a poker-type game which involves the play of more than one hand of cards.

In one embodiment, the game includes the step of dealing a first set of cards which are used to form a first hand of cards. In one embodiment, the player has the opportunity to select none, one or more cards from the first set of cards to hold or discard. Replacement cards are provided for each discarded card. The held cards and any replacement cards are used to form the first hand.

The outcome of the first hand is a winning outcome if the rank of the first hand is a predetermined rank or is a predetermined combination of cards. The ranks may comprise, for example, Pairs above the rank of Jack, Three of a Kind, a Flush, a Straight or the like.

If the outcome of the first hand is a winning outcome, the player may elect to stop the game and receive any winnings. Alternatively, the player may elect to continue the game. If the player continues the game, the player attempts to achieve a second or next hand having a higher rank than the first or previous hand. If the player elects to continue, a next set of cards are dealt and are used to form a next hand. In one embodiment, the player is again allowed to draw and replace cards.

The rank of the second or next hand is determined. If the rank of the second or next hand is higher than that of the first or previous hand, then the outcome of the game is a winning outcome. If the outcome of the game is a winning outcome, in one embodiment the player is permitted to continue playing unless the rank of the hand was the highest possible rank. In this version of the game, the player has the opportunity to play in seratim, a plurality of hands, so long as each successive hand has a higher rank than the previous hand and until the highest rank hand is obtained.

In one embodiment of the invention, the game is played as a wagering game. A player places a wager for the possibility of being paid winnings. In this embodiment, a first paytable provides winnings for predetermined winning combinations or ranks of first hands. A second paytable is preferably applicable to the second hand, a third paytable is applicable to the third hand and so on. Preferably, the payouts for winning combinations for each paytable increase for each successive hand.

In a preferred embodiment, the game is presented on an electronically controlled machine. Images of cards are displayed to the player using a display.

Further objects, features, and advantages of the present invention over the prior art will become apparent from the detailed description of the drawings which follows, when considered with the attached figures.

DETAILED DESCRIPTION OF THE INVENTION

The invention is a method of playing a game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises a method of playing a poker-type card game. In accordance with one embodiment of the invention, a player plays a first hand of poker. If the outcome of the first hand is a winning outcome, then the player has the opportunity to continue the game or complete the game by being paid any winnings associated with the winning outcome. If the player elects to continue the game, the player plays a second hand of poker. The outcome of the second hand is a winning hand if the second hand beats (i.e., has a higher "rank") than the first hand. In such event, the player has the opportunity to continue the game or complete the game by being paid any winnings associated with the winning outcome of the second hand. In general, the payouts for winning hands increase through each round of play, raising the stakes and the opportunity for large winning payouts.

Figure 1:
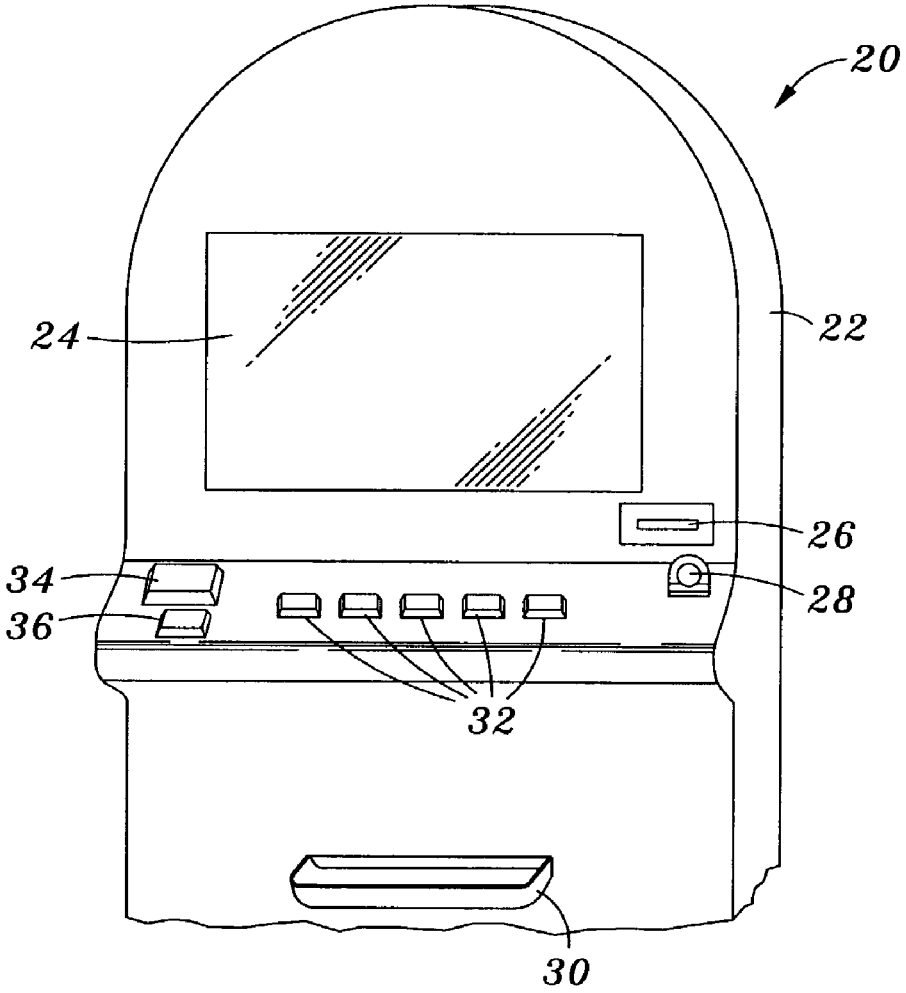
FIG. 1 illustrates a gaming device of the type which may be used to implement a game in accordance with the invention for play by a player.

In a preferred embodiment, the game is presented to a player with a gaming machine. FIG. 1 illustrates a gaming machine 20 in accordance with the invention. As illustrated, the gaming machine 20 includes a housing 22 for enclosing/supporting various components of the gaming machine. The gaming machine 20 includes a display 24 for displaying images of cards or other indicia. Speakers (not shown) or other devices may be provided for generating sound associated with the game.

In one embodiment, the game is played as a wager-type game which requires that a player place a bet or wager to play the game. Preferably, if the player is a winner of the game, then the player is provided an award, such as a monetary payout (such as coins) or other prizes. As illustrated, the gaming machine 20 may include a bill validator/acceptor 26 for accepting paper currency and a coin acceptor 28 for accepting coins. Other means of payment, such as a credit card reader, may be provided. An award of winnings in the form of coins may be paid to the player via a coin tray 30.

Preferably, the gaming machine 20 includes means for a player to provide input. In one embodiment, this means comprises one or more buttons. For example, a plurality of card "hold" or "select" buttons 32 may be provided for permitting a player to hold/select cards in a hand. A deal/draw button 34 permits a player to indicate that he/she wishes the game to start or to draw replacement cards. A bet button 36 is provided for a player to select the amount to bet on a particular game.

A game controller (not shown) is provided for controlling the various devices of the gaming machine and for providing game information. For example, the game controller may be arranged to generate video and audio data for presentation by the display and speakers of the gaming machine 20. The game controller may be arranged to detect a signal from the coin acceptor indicating the receipt of coins, and may be arranged to cause a coin delivery mechanism to deliver coins from a coin hopper to the coin tray 30.

It will be appreciated that the gaming machine 20 may have a variety of configurations, and that the gaming machine 20 illustrated and described above is but an example of a device for implementing the game of the present invention. In one or more embodiments, the gaming machine 20 may be associated with a network and receive game information remotely and may transmit information, such as payout and game play information, to a remote location.

One embodiment of a game in accordance with the present invention will be described with reference to FIGS. 2-9. One sequence of steps comprising a method of game play is illustrated in FIG. 9. Exemplary outcomes of those steps are illustrated in FIGS. 2-8, it being understood that a variety of other outcomes may result. Preferably, the game is presented at a gaming machine such as that illustrated in FIG. 1.

In a preferred embodiment, the game of the invention is played as a "wager" type game. In this form, as illustrated in step S1 of FIG. 9, a player places a wager or bet. The wager or bet may comprise money, such as coins or currency, or one or more elements representative of value, such as credits. The wager or bet may be placed in a variety of fashions, such as by inputting coins to the coin acceptor 28 or one or more bills to the bill validator 26. As is known, when a player provides monetary value, that value may be represented as credits on the gaming machine 20. The player may then utilize those credits to place the wager or bet.

Figure 2:
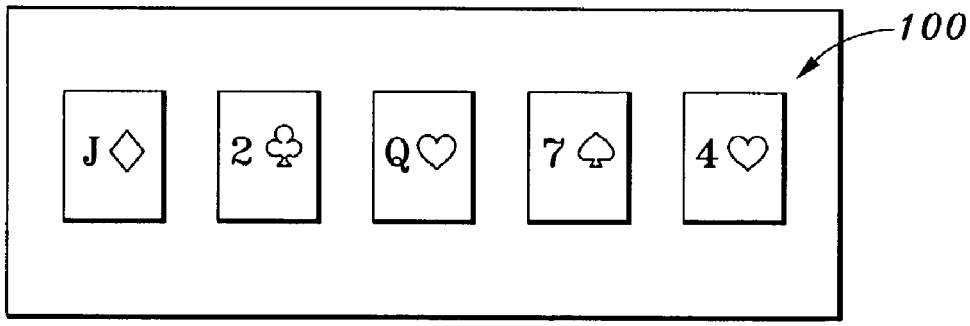
FIG. 2 illustrates an exemplary first set of cards provided in accordance with a game of the invention.

In a step S2, a set or hand of cards is dealt for use in playing a game. Preferably, as illustrated in FIG. 2, a set of five cards 100 is dealt. The set of cards 100 is preferably selected from a single deck of cards, though the cards may be selected from other sets of cards, such as multiple decks of cards.

As illustrated, the set of cards 100 is preferably dealt face up for viewing by the player. One or more of the cards may be dealt face-down and then turned over. In one embodiment, the cards may be dealt at one time or at different times. When played on a gaming machine, images of the cards are preferably generated and displayed on the display. The cards which are displayed may be selected using a random number generator, as is known to those of skill in the art.

Figure 3:
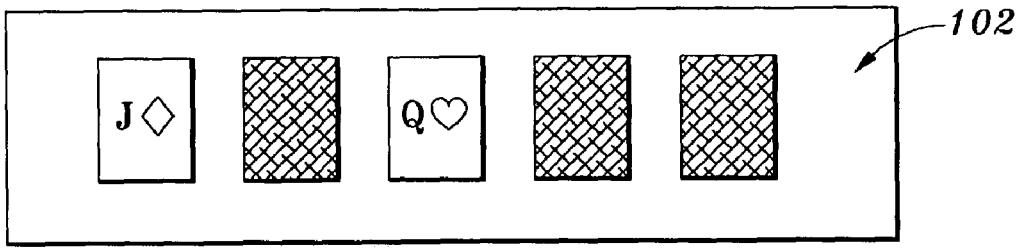
FIG. 3 illustrates an exemplary set of cards held from the set of cards illustrated in FIG. 2.

Referring to FIG. 9, in a step S3 in one embodiment, the player is permitted to discard one or more cards from the set of dealt cards 100. The player may make selections of cards to discard, or may make selections of cards to hold and have the un-held cards discarded. In one embodiment, the player may select none, one or more, or all of the cards to hold or discard. The player's selections may be input by various means, such as by touch-screen or by depressing "hold" or "discard" buttons. As illustrated in FIG. 3, after the player has made his/her hold/discard selections, a set of held cards 102 remains.

Figure 4:
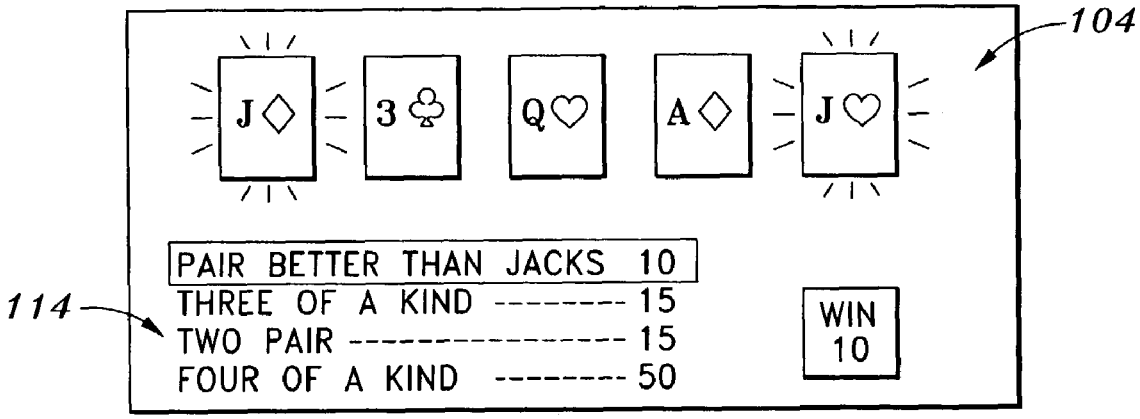
FIG. 4 illustrates an exemplary first hand after replacement cards have been provided, as well as winnings associated with a first paytable applicable to the first hand.

Referring again to FIG. 9, in a step S4, replacement cards are dealt or provided for each discarded card. In one embodiment, the replacement card or cards are selected from the same set of cards as the original set of cards 100. If a single deck of cards is being used, the replacement cards are preferably dealt from that same deck of cards. After replacement cards are dealt, if any, the remaining cards comprise a player's hand 104, as illustrated in FIG. 4.

Referring to FIG. 9, in a step S5, the rank of the hand is determined. In other words, it is next determined if the combination of cards comprising the hand is a winning combination of cards. Preferably, the hand is a winning hand if the combination of cards comprises one of a predetermined set of winning ranks or combinations. In one embodiment, those predetermined winning ranks or combinations are those commonly used in the game of Poker, such as Two Pair, Three of Kind, a Full House, a Royal Flush and the like. Of course, the particular predetermined winning combinations may vary. For example, a hand including a single Pair may be winning only if the Pair comprises Jacks or better.

In a step S6, if the hand is not a winning hand, then in a step S7, the game is over. In the event the game is being played as a wager type game, the player preferably loses his/her wager or bet.

If in step S6 the hand is determined to be a winning hand, then in a step S8, it is determined whether the player wishes to continue the game by attempting to beat his/her hand. If in this step the player does not wish to continue the game, then in a step S9, the player is preferably paid any winnings or is awarded any award resulting from the winning outcome. For example, in a preferred embodiment of the game, the player places a bet or wager for the opportunity, if a winning result is obtained, to be paid winnings. The winnings may comprise money or other value. After any winnings are paid, the game ends at step S7.

In step S8, the player may elect to continue the game. In a preferred embodiment, continued game play comprises one or more sequential attempts to beat the prior poker hand. In one embodiment, in order to continue the game, the player is not required to place an additional wager, but instead the player's original wager or bet and the amount won as a result of playing the first hand are utilized as the bet.

Figure 5:
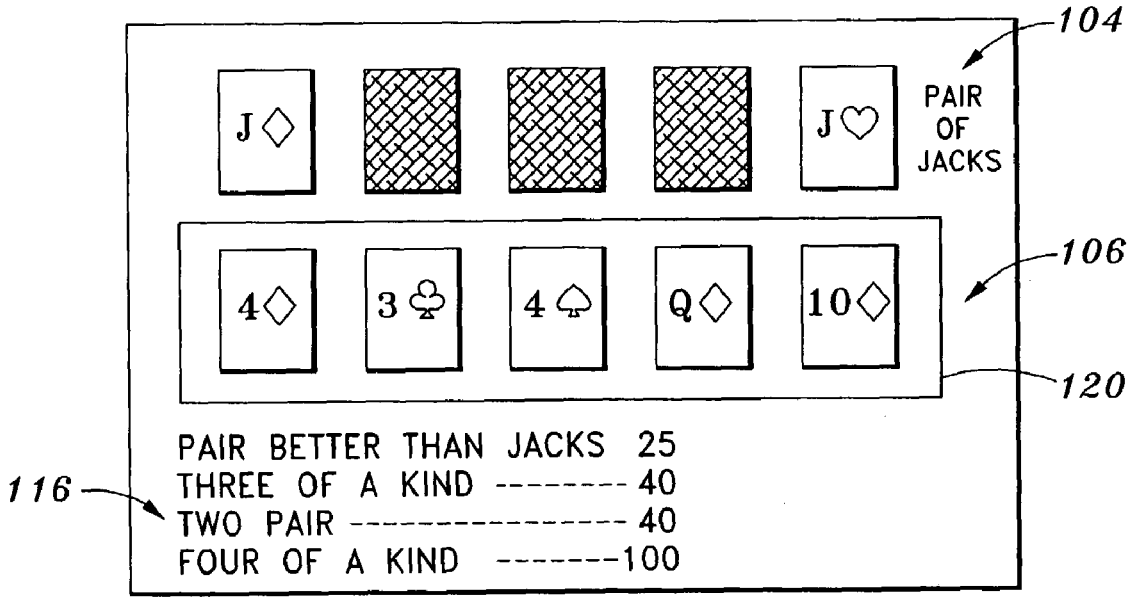
FIG. 5 illustrates an exemplary second set of cards.

If the player elects to continue the game, in a step S10, a next set of cards is dealt. FIG. 5 illustrates an exemplary next set of cards 106. As also illustrated in FIG. 5, the original winning hand 104 may be displayed to the player. This aids in identifying for the player the rank of the hand that he/she is trying to beat.

The next set of cards 106 is preferably dealt in the same fashion as the original hand of cards. In one embodiment, the next set of cards 106 is dealt from a new deck or set of cards separate from the first hand of cards 102. In another embodiment, the cards are dealt or provided from the same deck or set of cards from which the previous cards were dealt or provided.

Figure 6:
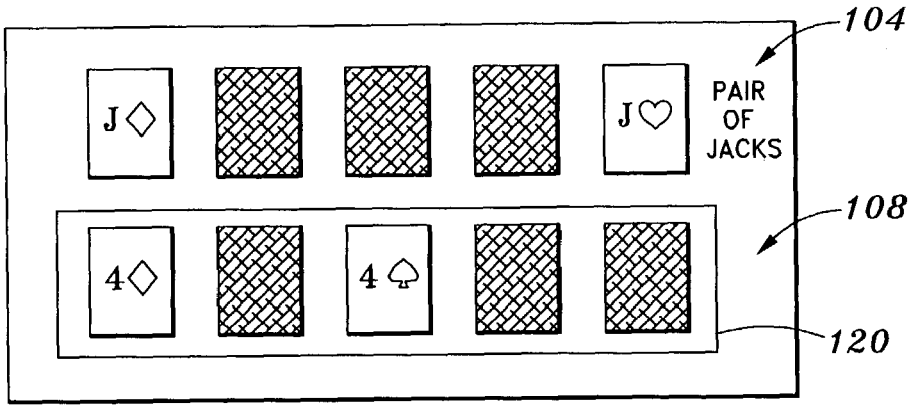
FIG. 6 illustrates an exemplary set of cards held from the second set of cards illustrated in FIG. 5.

Referring again to FIG. 9, in a step S11 the player preferably has the opportunity to select one or more cards to hold or discard. After the player makes such selections, the player has a set of held cards. FIG. 6 illustrates an exemplary set of held cards 108 after a player made card selections from the next hand of cards 106 illustrated in FIG. 5.

Figure 7:
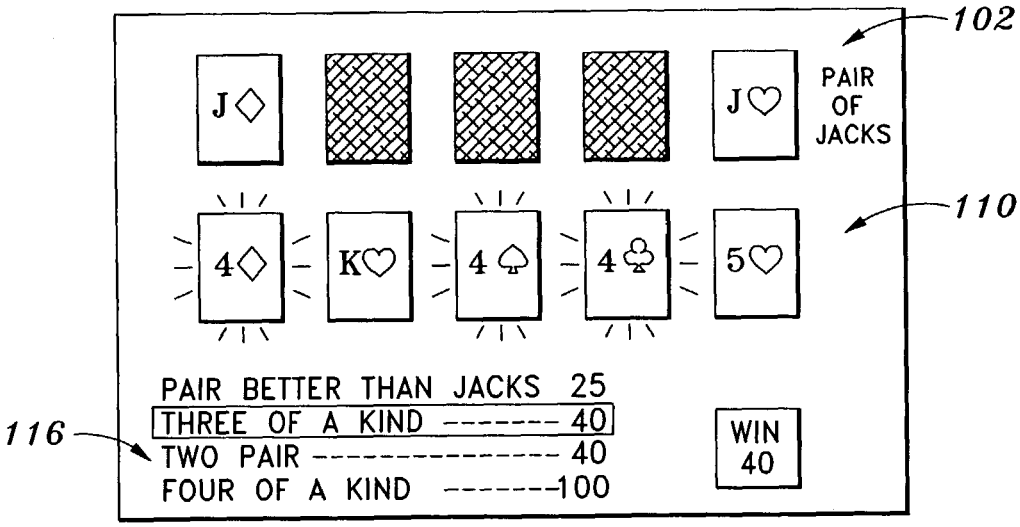
FIG. 7 illustrates an exemplary second hand after replacement cards have been provided, as well as winnings associated with a second paytable applicable to the second hand.

Referring again to FIG. 9, in a step S12 a replacement card is dealt for each card which is discarded or not held in order to complete a next hand of cards. FIG. 7 illustrates an exemplary next hand of cards 110 after replacement cards have been provided.

Referring to FIG. 9, in a step S13 it is determined if the next hand of cards beat the previous hand of cards. This step preferably comprises determining the rank of the next hand of cards and determining if that rank is higher than the rank of the previous hand of cards. If not, then the game ends at step S7. If the game ends in this fashion, the player is preferably paid no winnings.

If the next hand beat the previous hand, then the player is provided the option to continue the game in step S8. If the player does not wish to continue the game, any winnings are paid in step S9, and the game then ends at step S7. If so, then in step S10, the next set of cards is dealt.

In one embodiment, this sequence of play in which a player has the opportunity to beat his/her prior hand may continue until the player has received the highest possible hand rank, at which time the game preferably ends automatically and the player is paid winnings, since the player then no longer has the opportunity to achieve a higher-ranking hand.

FIG. 7 illustrates an exemplary next hand of cards 110. As illustrated, this next hand of cards 110 comprises includes three (3) Fours, or a Three of a Kind. In one embodiment, winning hands are ranked in accordance with normal poker rules. Of course, other rankings might be provided. In accordance with the embodiment illustrated, a Three of a Kind beats a Pair. As a result, the next hand of cards 110 beats (i.e., has a higher rank than) the previous hand 104. As such, the player has won the game.

Figure 8:
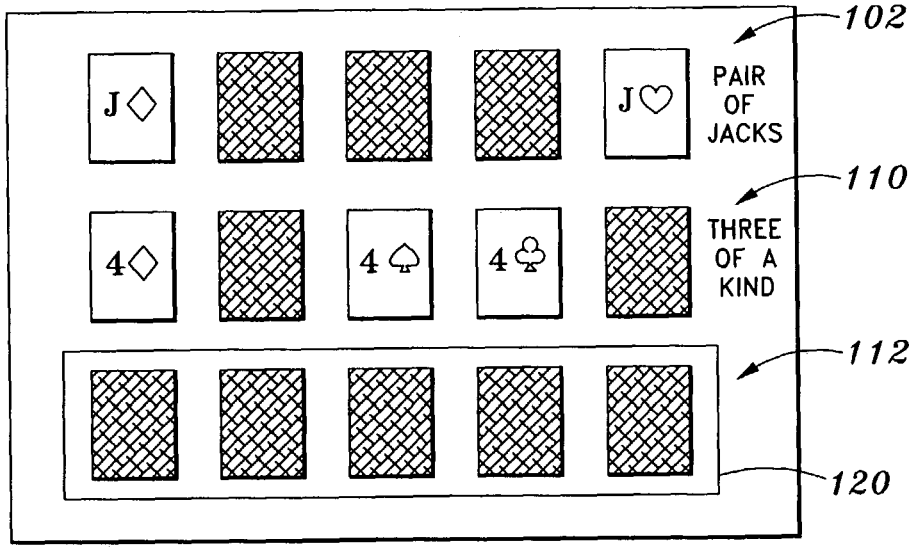
FIG. 8 illustrates an example of play including a third hand.
Figure 9:
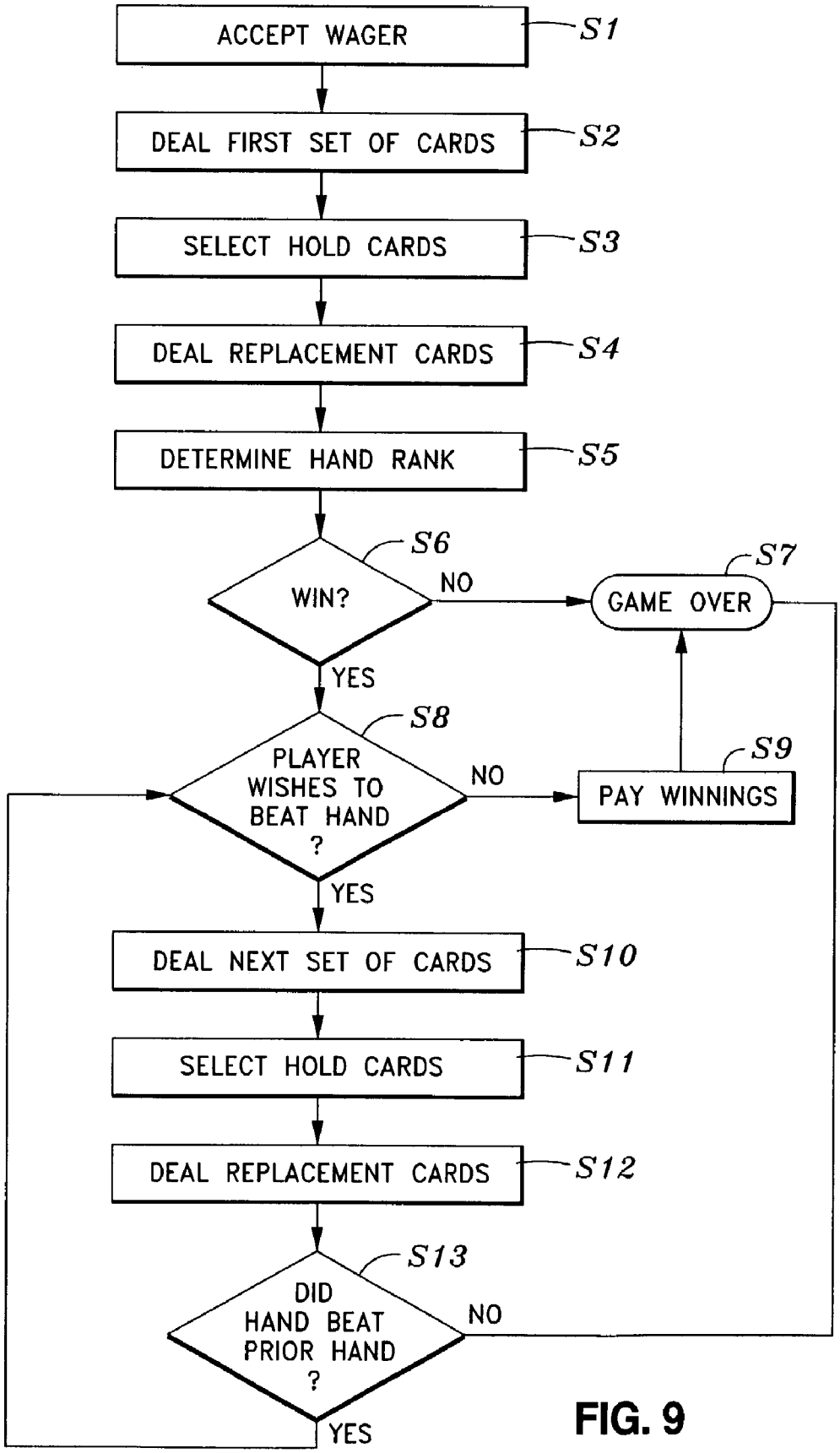
FIG. 9 is a flowchart illustrating an exemplary method of the invention.

FIG. 8 illustrates an exemplary embodiment of the game where, after winning the second hand, the player has elected to continue to play a next hand. As illustrated, the cards comprising the winning cards of the first hand 104 and second hand 110 are illustrated for the player's convenience. Card locations 112 are illustrated for the next set of cards to be dealt.

In accordance with one embodiment of the invention, the player has an opportunity to win significant payouts or jackpots as a result of the game play. FIG. 4 illustrates a partial paytable 114 for winnings paid for particular hands or hand ranks for the first hand of play. As illustrated, this paytable may utilize generally accepted payouts for video poker hands. In this instance, if a player has placed a wager or bet of 10 credits, the player is paid even money, or 10 credits, for a Pair comprising Jacks or better. Of course, the paytable may include payouts for a variety of other hands or ranks.

In accordance with the present invention, the player has the opportunity to win a payout or jackpot for beating his/her own hand. This paytable preferably reflects the risk associated with the player foregoing his/her previous winnings and attempting to achieve a higher hand. FIG. 5 illustrates an exemplary paytable 116 for a second or next winning hand which beats the prior hand. As illustrated, the payout for a Pair with a rank greater than the player's previous winning hand of a Pair of Jacks (i.e., a Pair of Queens or better) pays 25 credits. Notably, this is greater than the sum of the player's foregone winnings (10 credits). Preferably, the paytable continues to change for each successive hand played by the player, with the payouts for winning hands increasing greatly.

Various alternate configurations of the invention and other features are contemplated within the scope of the invention.

The game of the invention can be implemented by playing variations of poker. For example, the game could be played as Five Card Stud or Seven Card Stud poker. In the case of Five Card Stud, five cards would be dealt to the player and those cards would comprise the player's hand. The player would not be permitted to draw and replace any cards. In the case of Seven Card Stud, seven cards would be dealt to the player and the player would select five cards from the seven to comprise his/her hand.

In one embodiment, the active hand may be highlighted to the player, as illustrated in FIGS. 5, 6 and 8 by the active box 120. This is especially useful when the previous hand(s) is displayed to the player while a later hand is being played. Of course, other means may be used to indicate to the player which set of cards or hand is active.

The game may be played as a non-wagering game for entertainment purposes or for the right to win payouts or prizes. In such event, the player may not be required to place a wager or bet. The player may still be paid winnings, if desired, for winning outcomes. In one embodiment, the player may have the opportunity to win credits which have no monetary value. Those credits may simply be used to indicate the relative success of the player in playing the game, or may be redeemed for prizes or the like.

As illustrated, the game is preferably presented as a video poker type game at an electronic gaming machine, whether configured as a computer, mobile device, or specifically configured machine. The game could be played using physical cards, such as dealt at a table.

In one embodiment, the first set of cards could be re-used when playing subsequent hands. For example, if the player has received a winning first hand, the first set of cards may again be re-displayed and used in forming the next hand. The player may again select cards to hold/discard from the set of cards and then attempt to form a higher hand using the held cards from the first set of cards and any replacement cards.

In one embodiment, if a next hand of the game has the same rank as the previous round, then the outcome of the game is a losing outcome, i.e., the next hand did not beat the previous hand. For example, the outcome of the game may be a losing outcome if the second hand rank is a Pair of Jacks and the outcome of the first hand rank is a Pair of Jacks.

In another embodiment, if the outcome of the next and previous hands is the same rank, then the outcome may be neither a win or loss. Instead, the player may be permitted to play another "next" hand over in an attempt to beat the previous hand or the player may be permitted to stop the game and be paid the winnings associated with the previous winning hand or hands.

In one embodiment, winnings may accumulate. For example, if the player obtains a winning first hand, the player may be awarded a first winning amount. If the player obtains a losing second hand, then the first winning amount may be lost. If the player obtains a winning second hand, then the player may be awarded a second winning amount. The player may then quit the game and be awarded both the first and second winning amounts or continue the game.

The game of the invention has numerous advantages. First, the game is an exciting poker type game involving the potential to play more than a single hand. The game offers the player the opportunity to play multiple hands during a single game.

In addition, the game offers the player the opportunity for large payouts. In current video poker game play, the payouts for a single hand are restricted by the amount of the bet and the single set of odds for receiving particular outcomes. In the present invention, large payouts are available because of the odds associated with not only receiving particular winning hands, but hands which sequentially are higher than previous hands.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of operating a gaming system, said method comprising:

(i) causing a processor to operate with a display device and an input device to:

(a) provide a game, including displaying a first set of a plurality of cards;

(b) enable a player to select none, one or more than one card from the first set of cards;

(c) hold said selected cards from the first set of cards;

(d) discard each card not selected to be held from the first set of cards and provide a replacement card for each discarded card from the first set of cards;

(e) form a first hand with the held cards from the first set of cards and any replacement cards provided to the first set of cards; and (f) determine if the first hand comprises a winning hand of at least a first rank; and (ii) if said first hand comprises said winning hand of said first rank, causing the processor to operate with the display device and the input device to:

(a) display a second set of cards, said second set of cards including a same number of cards as the first set of cards;

(b) enable a player to select none, one or more than one card from the second set of cards;

(c) hold said selected cards from the second set of cards;

(d) discard each card not selected to be held from the second set of cards and provide a replacement card for each discarded card from the second set of cards;

(e) form a second hand with the held cards from the second set of cards and any replacement cards provided to the second set of cards;

(f) determine a second rank of the second hand;

(g) compare said second rank of said second hand with said first rank of said first hand; and (h) based on said comparison, display an indication that an outcome of the game is a winning outcome only if said second rank of said second hand is higher than said first rank of said first hand.

2. The method in accordance with claim 1 including enabling said player to terminate operation of said game if said first hand comprises said winning hand of said first rank.

3. The method in accordance with claim 2 which includes causing the processor to operate with the display device and the input device to provide an award for said winning hand of said first rank to said player.

4. The method in accordance with claim 1 which includes, if said second rank of said second hand is higher than said first rank of said first hand, and said second rank does not comprise the highest possible rank, causing the processor to operate with the display device and the input device to:

(a) display a next set of cards;

(b) enable the player to select none, one or more than one card from the next set of cards;

(c) hold said selected cards from the next set of cards;

(d) discard each card not selected to be held from the next set of cards and provide a replacement card for each discarded card from the next set of cards;

(e) form a next hand with the held cards from the next set of cards and any replacement cards provided to the next set of cards;

(f) determine a next rank of the next hand;

(g) compare said next rank of said next hand with said second rank of said second hand; and (h) display the next outcome of the game as a winning next outcome only if said next rank of said next hand is higher than said second rank of said second hand.

5. The method in accordance with claim 1 which includes causing the processor to operate with the display device and the input device to provide a first award based upon a first paytable for said winning hand of said first rank and provide a second award based upon a second paytable for said winning outcome, wherein said second paytable provides higher awards for the same hands or ranks as the awards provided by said first paytable.

6. A method of operating a gaming system, said method comprising:

(a) causing a processor to operate with a display device and an input device to:

(i) provide a game, including forming a first poker hand of cards; and (ii) determine a first rank of the first poker hand of cards;

(b) if said first rank of said first poker hand of cards is a winning rank, enabling a player to terminate operation of said game or continue operation of said game; and (c) if operation of said game is continued, causing the processor to operate with the display device and the input device to:

(i) form a second poker hand of cards, said second poker hand of cards including the same number of cards as said first poker hand of cards;

(ii) determine a second rank of said second poker hand of cards;

(iii) compare said second rank of said second poker hand of cards to said first rank of said first poker hand of cards; and (iv) based on said comparison, display an outcome of said game as a winning outcome only if said second rank of said second poker hand of cards is higher than said first rank of said first poker hand of cards.

7. The method in accordance with claim 6 including enabling a player terminate operation of said game or continue operation of said game if said first rank of said first poker hand of cards is a winning rank.

8. The method in accordance with claim 7 which includes causing the processor to operate with the display device and the input device to provide an award if operation of said game is terminated.

9. The method in accordance with claim 6 which includes, if said outcome of said game is a winning outcome and said second rank of said second poker hand of cards is not the highest possible rank, causing the processor to operate with the display device and the input device to:

(I) enable a player to terminate operation of said game or continue operation of said game;

(II) if operation of said game is continued, form a next poker hand of cards;

(III) determine a next rank of said next poker hand of cards;

(IV) compare the next rank of said next poker hand of cards to the rank of the previous hand;

(V) display the next outcome of said game as a winning next outcome only if said next rank of said next poker hand of cards is higher than said rank of the previous hand; and (VI) repeat steps (I)-(V).

10. The method in accordance with claim 9 which includes causing the processor to operate with the display device and the input device to terminate operation of said game if said next rank of said next poker hand of cards is the highest possible rank.

11. A method of operating a gaming system, said method comprising:

(a) causing a processor to operate with a display device and an input device to:

(i) provide a game, including forming a first poker hand of cards;

(ii) determine a first rank of said first poker hand of cards;

(iii) provide a first award in accordance with a first paytable of hand ranks if said first rank of said first poker hand of cards is a winning rank or form a second poker hand of cards, said second poker hand of cards including the same number of cards as the first poker hand of cards;

(iv) determine a second rank of said second poker hand of cards; and (v) compare said second rank of said second poker hand of cards with said first rank of said first poker hand of cards; and (b) based on said comparison, causing the processor to operate with the display device and the input device to provide a second award in accordance with a second paytable of hand ranks only if said second rank of said second poker hand of cards is higher than said first rank of said first poker hand of cards, said second paytable having one or more higher winning payouts for hand ranks than the winning payouts from the first paytable for the same hand ranks.

12. The method in accordance with claim 11 wherein causing the processor to operate with the display device and the input device to form said first poker hand of cards comprises causing the processor to operate with the display device and the input device to:

display a first set of cards;

hold none, one or more than one card from the first set of cards;

discard each card not held from the first set of cards; and provide a replacement card for each discarded card from the first set of cards.

13. The method of claim 1, which includes causing the processor to operate with the display device and the input device to:

take said first set of cards from a first deck of cards and provide said replacement card for each discarded card from the first set of cards from said first deck of cards; and take said second set of cards from a second deck of cards and provide said replacement card for each discarded card from the second set of cards from said second deck of cards.

14. The method of claim 6, which includes causing the processor to operate with the display device and the input device to:

take said first poker hand of cards from a first deck of cards; and take said second poker hand of cards from a second deck of cards.

15. The method of claim 11, which includes causing the processor to operate with the display device and the input device to:

take said first poker hand of cards from a first deck of cards; and take said second poker hand of cards from a second deck of cards.

* * * * *

UNITED STATES PATENT AND TRADEMARK OFFICE

CERTIFICATE OF CORRECTION

PATENT NO. : 7,749,059 B2
APPLICATION NO. : 10/434980
DATED : July 6, 2010
INVENTOR(S) : Elia Rocco Tarantino It is certified that error appears in the above-identified patent and that said Letters Patent is hereby corrected as shown below:

In Claim 4, Column 8, Line 8, replace "the highest" with --a highest--.

In Claim 9, Column 9, Line 3, replace "the highest" with --a highest--.

Signed and Sealed this

Fourteenth Day of September, 2010

David J. Kappos

David J. Kappos
*Director of the United States Patent and Trademark Office*